US006474320B1

(12) United States Patent
Modien

(10) Patent No.: US 6,474,320 B1
(45) Date of Patent: Nov. 5, 2002

(54) LINEAR ELECTRIC EGR VALVE WITH DAMPED MOVEMENT

(75) Inventor: Russell Modien, Chatham (CA)

(73) Assignee: Siemens Automotive Inc., Ontario (CA)

( * ) Notice: Subject to any disclaimer, the term of this patent is extended or adjusted under 35 U.S.C. 154(b) by 0 days.

(21) Appl. No.: 09/971,879

(22) Filed: Oct. 5, 2001

(51) Int. Cl.[7] ..... F02M 25/07
(52) U.S. Cl. ..... 123/568.21; 251/129.15
(58) Field of Search ..... 123/568.21; 251/129.15; 335/262, 219

(56) References Cited

U.S. PATENT DOCUMENTS 5,460,146 A * 10/1995 Frankenberg ..... 251/129.15
5,669,364 A * 9/1997 Everingham ..... 123/568.21
6,089,467 A * 7/2000 Fochtman et al. ..... 251/129.15
6,189,519 B1 * 2/2001 Press et al. ..... 123/568.21
6,247,461 B1 * 6/2001 Smith et al. ..... 123/568.21

* cited by examiner

*Primary Examiner*—Paul J. Hirsch

(57) ABSTRACT

An automotive emission control valve, such as an EGR valve, has a solenoid for operating a valve element. The solenoid has a stator and an armature. The armature is guided within a sleeve and includes a damping ring disposed to act between the armature and the sleeve to damp motion of the armature within the sleeve.

10 Claims, 2 Drawing Sheets

LINEAR ELECTRIC EGR VALVE WITH DAMPED MOVEMENT

FIELD OF THE INVENTION

The invention relates generally to electric-actuated automotive emission control valves, and more particularly to exhaust gas recirculation (EGR) valves for internal combustion engines that power automotive vehicles.

BACKGROUND OF THE INVENTION

A solenoid is a known electric actuator for an EGR valve. The solenoid comprises an electromagnet coil and a stator having an air gap at which magnetic flux acts on an armature. The armature motion is transmitted to a valve member to allow flow through a passageway of the valve. Armature motion is resisted by a return spring that acts on the armature, either directly or via the valve member, to bias the armature toward a position that causes the valve member to close the passageway.

In a linear solenoid valve, displacement of the armature, and also of the valve member when the valve member is displaced in exact correspondence with the armature, should theoretically bear a relationship of direct proportionality to the electric current in the solenoid coil. In other words, a graph plot of armature displacement versus electric current for such a valve should start at the origin of the graph and extend from the origin at a constant slope.

A known linear solenoid EGR valve comprises a stator having an upper stator part that is disposed at an upper end of the coil and a lower stator part at the lower end of the coil. These two parts have respective cylindrical walls, one tapered and the other non-tapered, that fit into the open center of the coil, approaching each other from opposite ends of the coil. The juxtaposed ends of the two walls are spaced apart within the open interior of the coil, and their construction and arrangement define an annular air gap disposed circumferentially around the armature. Electric current in the coil creates magnetic flux that passes from one wall across the air gap to the armature, through the armature, and back across the air gap to the other wall. The flux causes magnetic force to be applied to the armature, and the axial component of that force acts to displace the armature along the centerline of the solenoid in a substantially linear relationship of armature displacement to coil current.

Where flow through the valve is proportional to armature displacement, the functional relationship of flow to electric coil current is also substantially linear. In an EGR valve, knowledge of the relationship of armature displacement to coil current is essential to a control strategy that accurately meters exhaust gas into the engine intake system, and such linearity facilitates implementation of the control strategy in a particular engine.

For various reasons, such as smaller engines, and use of multiple EGR valves on an engine, certain automotive vehicle manufacturers are seeking to reduce the size of EGR valves, but without sacrificing desired control accuracy.

The present invention arises as a consequence of the inventor's observations about such smaller valves. In particular, the inventor has observed that because such a valve has a smaller mass, its less massive internal mechanism is more likely to be affected by external perturbations that the valve experiences when in use. Examples of such perturbations include: pulsations in the fluid whose flow is being controlled; mechanical vibrations arising from operation of the vehicle and running of the engine that powers the vehicle; and instabilities in control strategies for a valve.

Such perturbations may be significant enough to impart disturbances to the valve mechanism in ways that are contrary to intended control strategy. Accordingly, improvements in the solenoid that would attenuate, and ideally eliminate, such effects are believed desirable, and it toward that end that the present invention is directed.

SUMMARY OF THE PRESENT INVENTION

It is therefore an object of this invention to provide such improvements, particularly in linear solenoid actuators of EGR valves.

One general aspect of the invention relates to an emission control valve for controlling flow of gases with respect to combustion chamber space of an internal combustion engine. The valve comprises a valve body comprising a passageway having an inlet port for receiving gases, an outlet port for delivering gases to the combustion chamber space, a valve element that is selectively positioned to selectively restrict the passage, and a mechanism for selectively positioning the valve element. The mechanism comprises a solenoid having an electromagnet coil, a stator that is associated with the coil and that has a magnetic circuit comprising an air gap for conducting magnetic flux generated in the stator when electric current flows in the coil, and an armature that is disposed in the air gap to be displaced along an imaginary centerline by the magnetic flux. The armature is guided within a sleeve. A damping ring is disposed to act between the armature and the sleeve to damp motion of the armature within the sleeve.

The accompanying drawings, which are incorporated herein and constitute part of this specification, include one or more presently preferred embodiments of the invention, and together with a general description given above and a detailed description given below, serve to disclose principles of the invention in accordance with a best mode contemplated for carrying out the invention.

DESCRIPTION OF THE PREFERRED EMBODIMENT

Figure 1:
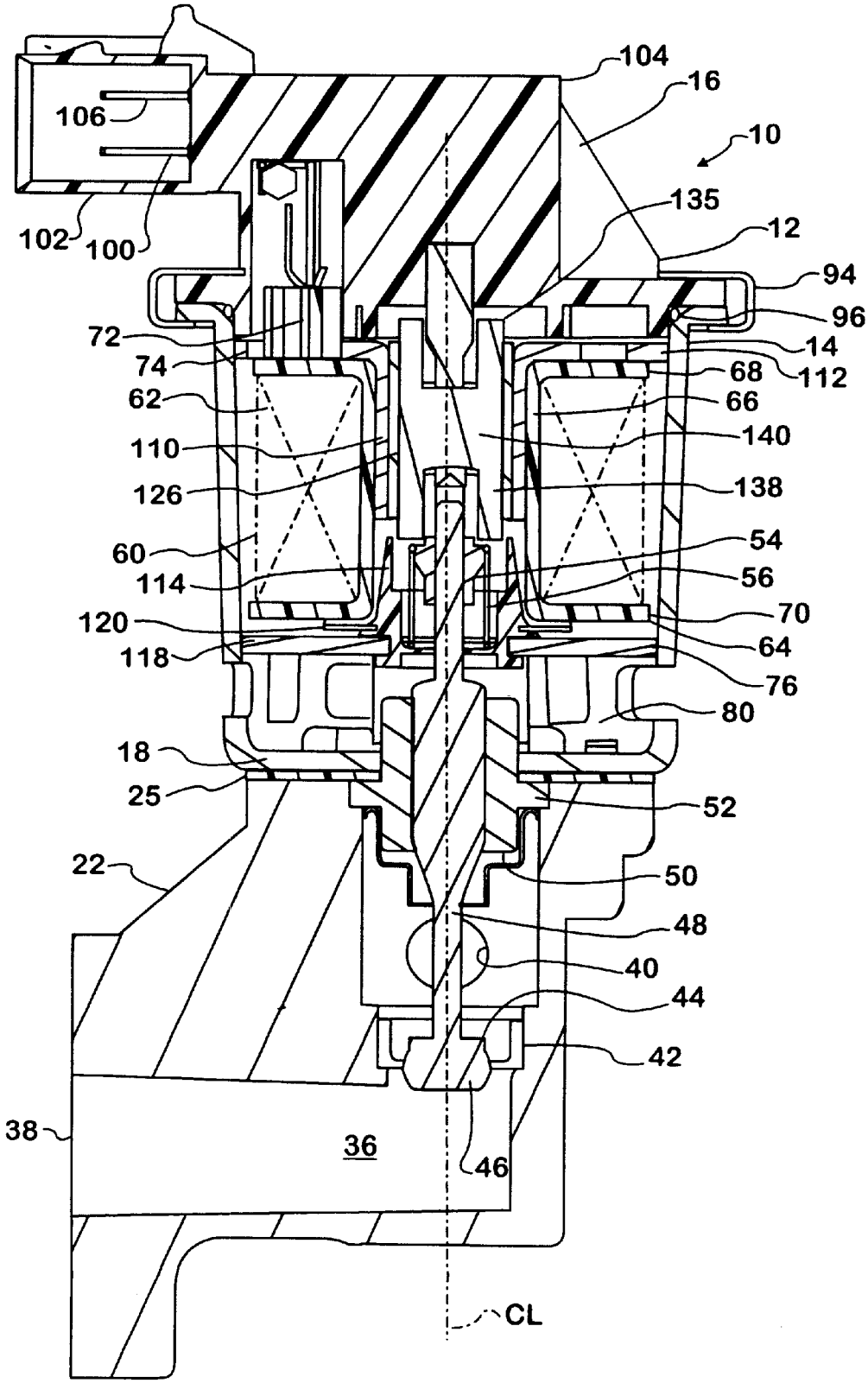
FIG. 1 is an elevation view, substantially in cross section, of an exemplary embodiment of the present invention comprising an electric EGR valve have a solenoid as the actuator.

FIG. 1 shows an exemplary EEGR valve 10 that comprises a housing assembly 12 provided by a shell 14 having an open upper end that is closed by a cap 16. Shell 14 further comprises a flat bottom wall 18 that is disposed atop a flat upper surface of a base 22 with a spacer 25 between them. Fasteners (not shown) secure the shell to the base. Base 22 is adapted to mount on a component of an internal combustion engine not specifically shown in the drawing.

Valve 10 comprises a flow passage 36 extending through base 22 between an inlet port 38 and an outlet port 40. With valve 10 mounted on the engine, inlet port 38 is placed in communication with engine exhaust gas expelled from the engine cylinders and outlet port 40 is placed in communication with the intake flow into the cylinders.

An annular valve seat element 42 comprising a through-hole is disposed in passage 36 with its outer perimeter sealed to the passage wall. A one-piece valve member 44 comprises a valve head 46 and a valve stem 48 that extends co-axially from head 46 along an imaginary centerline CL of the valve. Head 46 is shaped for cooperation with seat element 42 to close the through-hole in the seat element when valve 10 is in closed position shown in FIG. 1.

Valve 10 further comprises a bearing member 50 that is basically a circular cylindrical member having a circular flange 52 for seating in a counter-bore at one end of a hole that lies on centerline CL. Member serves to guide valve motion along centerline CL by having a close fit with stem 48.

Stem 48 extends, diametrically reduced, beyond the upper end of bearing member 50 where a spring locator member 54 is fit to it to provide a seat for one axial end of a helical coil spring 56. Bearing member 50 may comprise a material that possesses some degree of lubricity providing for low-friction guidance of valve member 44 along centerline CL. The opposite axial end of spring 56 seats on an internal shoulder of a lower pole piece 76.

Valve 10 further comprises an electromagnetic actuator 60, namely a solenoid, disposed within shell 14 coaxial with centerline CL. Actuator 60 comprises an electromagnetic coil 62 and a polymeric bobbin 64. Bobbin 64 comprises a central tubular core 66 and flanges 68, 70 at opposite ends of core 66. Coil 62 comprises a length of magnet wire wound around core 66 between flanges 68, 70. Respective terminations of the magnet wire are joined to respective electric terminals mounted side-by-side on flange 68, only one terminal 72 appearing in the view of FIG. 1.

Actuator 60 comprises stator structure associated with coil 62 to form a portion of a magnetic circuit path. The stator structure comprises an upper pole piece 74, disposed at one end of the actuator coaxial with centerline CL, and a lower pole piece 76 disposed at the opposite end of the actuator coaxial with centerline CL. The portion of shell 14 between pole pieces 74, 76 complete the stator structure exterior of the coil and bobbin. Cap 16 comprises an outer margin that is held secure against a rim 92 at the otherwise open end of the shell side wall by a clinch ring 94. A circular seal 96 between the cap and shell makes a sealed joint between them. Cap 16 comprises a first pair of electric terminals, only one terminal 100 appearing in FIG. 1, that mate respectively with the terminals on bobbin flange 68. The cap terminals protrude externally from the cap material where they are bounded by a surround 102 of the cap material to form a connector adapted for mating connection with a wiring harness connector (not shown) for connecting the actuator to an electric control circuit.

Cap 16 also comprises a tower 104 providing an internal space for a position sensor that comprises plural electric terminals, only one terminal 106 appearing in the Fig., that protrude into the surround for connecting the sensor with a circuit via the mating wiring harness connector.

The construction of valve 10 is such that leakage between passage 36 and air circulation space 80 is prevented. Valve stem 48 has a sufficiently close sliding fit within bearing member 50 to prevent leakage between passage 36 and air circulation space 80 while providing low-friction guidance of the stem along centerline CL.

Upper pole piece 74 is a ferromagnetic part that comprises a central, cylindrical-walled, axially-extending hub 110 and a circular radial flange 112 at one end of hub 110. Hub 110 is disposed co-axially within the upper end of a circular through-hole in bobbin core 66 concentric with centerline CL, and flange 112 is disposed against bobbin flange 68, thereby axially and radially relating bobbin 64 and upper pole piece 74. Flange 112 has a clearance slot for bobbin terminals 72.

Lower pole piece 76 is ferromagnetic and comprises a circular annular ring 118 that girdles and is fit to a central tapered hub 114 that extends from ring 118 into the bobbin core through-hole, but stopping short of hub 110. An annular wave spring 120 is disposed between ring 118 and bobbin flange 70 for maintaining bobbin flange 68 against flange 112 to compensate for differential thermal expansion.

Actuator 60 further comprises a ferromagnetic armature 135 arranged for displacement along centerline CL. Armature displacement is guided in any suitable way, such as by a cylindrical non-ferromagnetic part, or sleeve, 126 that is fit coaxially within hub 110. Armature 135 cooperates with the stator structure in forming the magnetic circuit of actuator 60.

Armature 135 comprises a circular cylindrical outer wall 138 of suitable radial thickness for the magnetic flux that it conducts. Midway between its opposite ends armature 135 has a transverse wall 140. Spring 56 biases a tip end of spring locator member 54 against one side of wall 140 while the plunger of the position sensor housed within tower 104 is biased against the opposite side of wall 140.

FIG. 1 shows the closed position of valve 10 wherein a pre-load force is being applied by spring 56 to force valve head 46 to seat on seat element 42, closing passage 36 to flow between ports 38 and 40. As electric current begins to increasingly flow through coil 62, the magnetic circuit exerts increasing force urging armature 135 in the downward direction as viewed in FIG. 1. Once the force is large enough to overcome the bias of the pre-load force of spring 154, armature 135 begins to move downward, similarly moving valve element 44 and opening valve 10 to allow flow through passage 36 between the two ports. The extent to which the valve is allowed to open is controlled by the electric current in coil 62, and by tracking the extent of valve motion, the position sensor can provide a feedback signal representing valve position, and hence the extent of valve opening. The actual control strategy for the valve is determined as part of the overall engine control strategy embodied by an associated electronic engine control.

Figure 2:
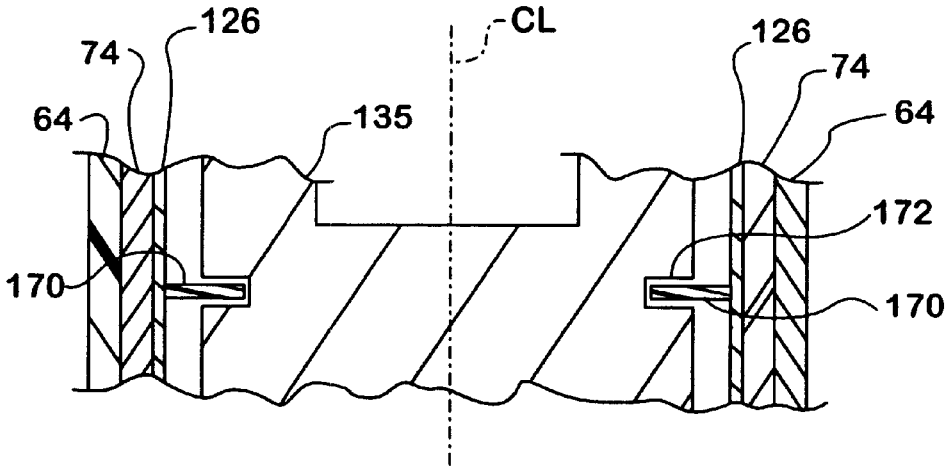
FIG. 2 is an enlarged view of a portion of FIG. 1.

In accordance with principles of the invention, damping is intentionally introduced into actuator 60 to damp armature displacement along centerline CL. A first embodiment is disclosed in FIGS. 2 and 3, and it should be understood that the scale of FIG. 1 does not permit this embodiment to appear conveniently in that Fig. although it is in fact present. The first embodiment comprises a split ring 170 that is fit to a circumferential groove 172 in armature 135. FIG. 4 shows a second embodiment of split ring. The outer edge of each is essentially circular. The difference between them resides essentially in the shape of the inner edge. The thickness is uniform. Each ring is capable of being circumferentially expanded to fit over the end of armature 135 and be moved along the armature toward groove 172. Once registration with the groove has been achieved, the ring is released and its inherent elasticity circumferentially contracts it, lodging its inner margin in the groove. The outer margin of the split ring then protrudes outward beyond the outside diameter of the armature.

Figure 3:
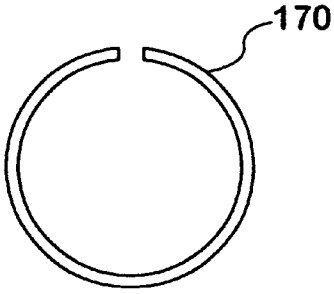
FIG. 3 is a full plan view of one part of the valve shown by itself and looking in the direction of arrows 3—3 in FIG. 2.
Figure 4:
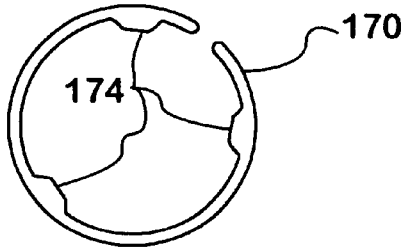
FIG. 4 is a view like FIG. 4 showing another embodiment of the one part.

The ring of FIG. 3 has an essentially circular inner edge that is free of lands. Self-centering of the ring of FIG. 4 on the armature is achieved by providing its inner edge with three lands 174 essentially equiangularly spaced. The outer edge of each ring defines a diameter that is less than the inside diameter of sleeve 126 by some amount. Depending on specific design, the outside diameter of ring 170 in its free condition may be slightly greater than the inside diameter of the sleeve, in which case, the outer edge will exert an outwardly directed force against the wall of the sleeve, creating friction. Damping of armature motion due to such friction will be additional to any pneumatic damping created by the presence of ring 170 in the clearance space between the armature and sleeve. A suitable material for split ring 170 is a synthetic material, such as polytetrafluroethylene (PTFE).

Figure 5:
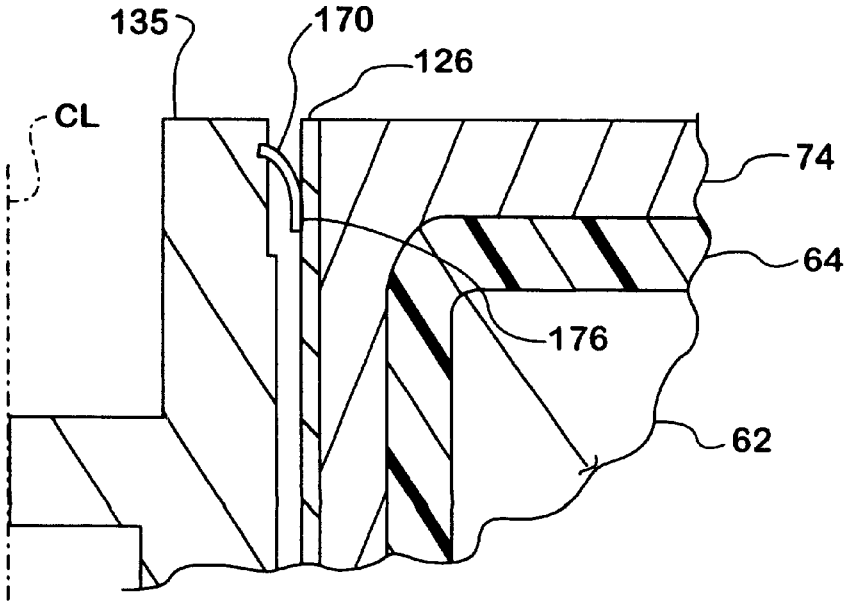
FIG. 5 is a fragmentary cross section view of a still further embodiment.

FIG. 5 shows still another example where ring 170 is a cup having an inner margin lodging in groove 172. The outer margin forms a curved lip 176 that exhibits a wiping type action against the sleeve wall.

The total amount of damping is a function of various factors additional to the inclusion of any of the various embodiments of rings 170. The invention allows armature damping to range from predominantly friction damping to predominantly pneumatic damping depending on design details. The extent to which a split ring exerts radial force on the sleeve is a major factor in friction damping. The extent to which air is trapped in various spaces whose volumes change as the armature moves is a major factor in pneumatic damping. By making armature wall 140 imperforate, air cannot pass through the armature, only around the armature, in the space between the armature and sleeve, to the extent that air can pass through that space.

Armature mass, radial magnetic force, and rate of spring 56 also influence damping. Characteristics of the valve mechanism, such as valve head size and the amount of force-balancing, are also factors.

The particular embodiments that have been illustrated in the drawings have a single split ring. In those embodiments, the outer cylindrical surface of armature wall 138 preferably has lubricity to minimize friction with the inner wall of sleeve 126. Other embodiments not specifically illustrated comprise two split rings that are spaced axially apart along centerline CL. The cooperation of the two split rings with the wall of sleeve 126 provide armature guidance.

While the foregoing has described a preferred embodiment of the present invention, it is to be appreciated that the inventive principles may be practiced in any form that falls within the scope of the following claims.

What is claimed is:

1. An emission control valve for controlling flow of gases with respect to combustion chamber space of an internal combustion engine comprising:

a valve body comprising a passageway having an inlet port for receiving gases and an outlet port for delivering gases to the combustion chamber space, a valve element that is selectively positioned to selectively restrict the passage, and a mechanism for selectively positioning the valve element comprising a solenoid having an electromagnet coil, a stator that is associated with the coil and that has a magnetic circuit comprising an air gap for conducting magnetic flux generated in the stator when electric current flows in the coil, and an armature that is disposed in the air gap to be displaced along an imaginary centerline by the magnetic flux and that is guided within a sleeve, including a damping ring disposed to act between the armature and the sleeve to damp motion of the armature within the sleeve.

2. An emission control valve as set forth in claim 1 wherein the damping ring is disposed on the armature to move with the armature as the armature is displaced within the sleeve.

3. An emission control valve as set forth in claim 2 wherein the damping ring comprises a split ring.

4. An emission control valve as set forth in claim 3 wherein the armature comprises a groove in which the split ring is received.

5. An emission control valve as set forth in claim 4 wherein the split ring comprises an inner edge containing lands for making the split ring self-centering within the groove.

6. An emission control valve as set forth in claim 4 wherein the split ring comprises a synthetic material and has a flat shape.

7. An emission control valve as set forth in claim 2 wherein the damping ring comprises a cup having a curved outer lip.

8. An emission control valve as set forth in claim 2 wherein the armature is imperforate and is guided within a sleeve, and the split ring is in contact with the sleeve.

9. An emission control valve as set forth in claim 1 wherein the armature is cylindrical in shape and imperforate, the damping ring is disposed around the armature and is in contact with a sleeve that guides armature motion.

10. A method of operating an emission control valve for controlling flow of gases with respect to combustion chamber space of an internal combustion engine, the valve comprising a valve body comprising a passageway having an inlet port for receiving gases and an outlet port for delivering gases to the combustion chamber space, a valve element that is selectively positioned to selectively restrict the passage, and a mechanism for selectively positioning the valve element comprising a solenoid having an electromagnet coil, a stator that is associated with the coil and that has a magnetic circuit comprising an air gap for conducting magnetic flux generated in the stator when electric current flows in the coil, and an armature that is disposed in the air gap to be displaced along an imaginary centerline by the magnetic flux and that is guided within a sleeve, the method comprising:

damping armature motion by a damping ring disposed to act between the armature and the sleeve to damp motion of the armature within the sleeve.

* * * * *